United States Patent [19]

Rossi

[11] 4,250,367

[45] Feb. 10, 1981

[54] SNAP ACTION SWITCH BLADES

[75] Inventor: Guglielmo Rossi, Stutensee-Friedrichstal, Fed. Rep. of Germany

[73] Assignee: Ranco Incorporated, Columbus, Ohio

[21] Appl. No.: 924,696

[22] Filed: Jul. 14, 1978

[51] Int. Cl.[3] ..... H01H 5/22

[52] U.S. Cl. ..... 200/275; 200/67 DA

[58] Field of Search ..... 29/622; 200/275, 283, 200/67 D, 67 DA, 67 R

[56] References Cited

U.S. PATENT DOCUMENTS

| | | | |
|---|---|---|---|
| 2,805,297 | 9/1957 | Campbell | 200/67 |
| 3,196,233 | 7/1965 | Burch et al. | 200/67 DA |
| 4,118,609 | 10/1978 | Schadow et al. | 200/67 DA |

FOREIGN PATENT DOCUMENTS

| | | | |
|---|---|---|---|
| 2002659 | 8/1971 | Fed. Rep. of Germany | 200/67 |
| 1142435 | 4/1957 | France | 200/67 |
| 2291598 | 11/1976 | France | 200/67 |
| 496311 | 10/1970 | Switzerland | 200/67 |

*Primary Examiner*—Houston S. Bell, Jr.

*Attorney, Agent, or Firm*—Watts, Hoffmann, Fisher & Heinke, Co.

[57] ABSTRACT

A snap action switch blade has two resilient legs which project from an integral base portion beyond and on each side of a tongue to which an operating force is applied. The legs are joined together by a contact element which is welded to two inwardly projecting arms at the free ends of the legs, drawing the latter together to prestress the blade with a dish deformation. The two arms may be narrower than the legs, their common centerline being spaced from the contact zone of the contact, so that a twisting action is imparted to arms prior to separation of the contact from a fixed contact, assisting in breaking contact welds.

6 Claims, 5 Drawing Figures

SNAP ACTION SWITCH BLADES

This invention relates to snap action switch blades.

Various configurations of snap-action switch blade are known in the art of electrical switches and controls which effect snap opening of switch contacts when an operating force applied to a part of the switch blade reaches a predetermined threshold value. The snap action of the switch blade results from a prestressing of the blade so that the blade tends to adopt stable configurations of minimum stress in which a switch contact carried by the blade is in different positions relative to a point of anchorage of the blade. In moving between the stable configurations the blade is unstable, and accordingly it moves rapidly to one stable position or the other, according to the direction in which a force is applied to the blade, moving the switch contact with a snap action.

Snap-acting switch blades are described in U.K. Patent Application Nos. 49726/74 and 12857/75. An object of the present invention is to provide an improved snap-action switch blade which, compared with many types of known blade, is of simple construction lending itself readily to economic quantity production.

According to the invention there is provided a snap action switch blade of resilient sheet metal comprising a base portion, an inwardly projecting tongue, an outwardly projecting tongue, two resilient legs projecting from opposite sides of the base portion and terminating beyond the inwardly projecting tongue in respective resilient arms which project laterally inwardly towards each other, and a contact element affixed to the two arms and interconnecting them in a stressed condition in which the arms are drawn together, causing a dish deformation of the base portion, and prestressing the blade for snap movement of the contact when an operating force is applied to one of the tongues while the end of the other tongue is anchored.

The contact element itself serves to interconnect the arms of the switch blade, avoiding the necessity to provide a separate bridging piece interconnecting the arms, with a contact affixed thereto.

An important characteristic of the blade according to the invention is that the contact element interconnects the resilient arms at the outer ends of the two legs of the blade, serving both as an electrical contact and drawing the two arms together to stress the blade and predispose it for snap action. Since it is not necessary to affix a separate contact element to the blade, after deformation thereof and interconnection of the arms, the blade construction is simplified considerably and is therefore potentially economical in mass production.

Preferably the outwardly projecting tongue terminates in a flat portion adapted to be anchored to a fixed support, this flat portion having a greater width than the remainder of the outwardly projecting tongue. When the said flat portion of the blade is anchored to a fixed support the blade as a whole acts as a cantilever resisting elastically the operating force applied to the inwardly projecting tongue. The elasticity of this mounting cantilever can be predetermined by appropriate choice of the length and width of the outwardly projecting tongue, to predispose the blade for monostable or bistable snap movement according to the practical application for which the switch is intended.

A further important feature of the switch blade according to the invention is that the resilience of the two laterally inwardly projecting arms to which the contact element is affixed affords a degree of elasticity in the mounting of the contact element, which serves to resist and dampen any tendency for "contact bounce" when the conact element closes upon a fixed contact in use of the switch blade.

In a preferred embodiment of the invention the two laterally inwardly projecting arms terminate in end portions of enlarged width to which the contact element is affixed, the centre or contact area of the contact element being spaced from the longitudinal centreline of the two arms so that contact pressure exerted on the contact element causes torsional stress in the two arms. The torsional stress which exists in the two arms carrying the contact element when the latter is held by the switch blade against a fixed switch contact ensures that upon contact separation a wiping action takes place relative to the fixed switch contact, breaking any welds which may form in use of the switch blade. This wiping action, and the effective damping of any tendency to contact bounce may be enhanced by so dimensioning the switch blade that the two laterally inwardly projecting arms which carry the contact element are narrower in width than the two legs of the switch blade upon which the arms are formed.

The contact element of the switch blade should be of a material which can easily be welded to the arms of the switch blade, while presenting a suitable contact surface. Preferably therefore the contact element of the switch blade comprises a base portion which is affixed to the two laterally inwardly projecting arms and an electrically conductive contact layer which is deposited on or bonded to the base portion. The contact element may conveniently be of square or rectangular shape, severed from a continuous strip, each contact element being formed with two raised parallel ribs on its base portion along which the contact element is welded to the arms of the blade.

The invention also comprehends a method of making the snap action switch blade herein defined, comprising stamping or otherwise forming a flat blade blank of resilient sheet metal with a base portion, inwardly and outwardly projecting tongues, two legs projecting from opposite sides of the base portion and extending generally parallel to the inwardly projecting tongue, terminating beyond the latter in respective arms which project laterally inwardly towards each other, the inner ends of the said arms being spaced from each other by a gap, anchoring the base portion of the blade blank while deforming the outer ends of the two legs laterally towards each other to reduce the gap between the arms and stress the blade, and affixing to the two arms a contact element which interconnects the arms and maintains the blade in its stressed condition. The contact element would in practice preferably be affixed to the two arms by a welding operation, the steps of deforming the blade blank and welding the contact element in position being conveniently performed in an automatic sequence, using a suitable jig. To assist the accurate deformation to the blade blank the two legs of the latter may be formed at their ends with laterally outwardly projecting lugs to which laterally inwardly directed forces are applied to deform the outer ends of the two legs laterally inwardly towards each other, prior to the affixing of the contact element to the laterally inwardly projecting arms carried by the legs.

The invention will be further described and illustrated, by way of example, with reference to the accompanying purely diagrammatic drawings, in which.

Figure 1:
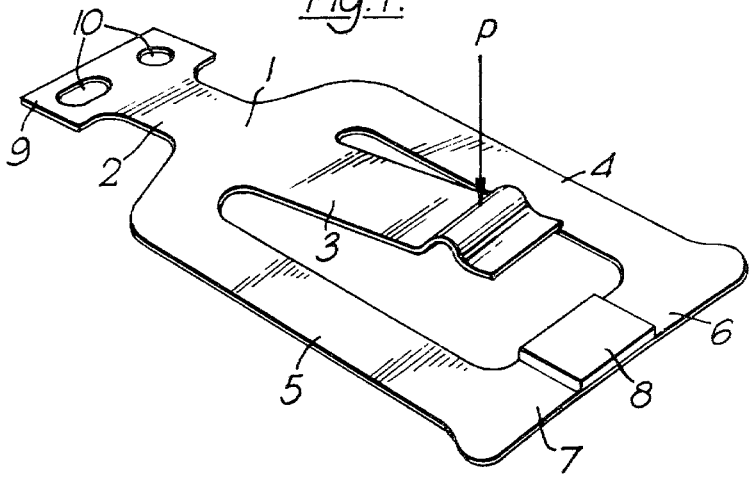
FIG. 1 is a diagrammatic perspective view of a snap action switch blade according to one embodiment of the invention.

The snap action switch blade shown in FIG. 1 comprises a sheet of resilient sheet metal, for example beryllium copper having a thickness of 0.25 millimetre. The blade is formed with a base portion 1, an inwardly projecting tongue 2, an outwardly projecting tongue 3 and two resilient legs 4, 5 projecting from opposite sides of the base portion 1, the legs 4, 5 being substantially parallel to each other and terminating beyond the end of the inwardly projecting tongue 3 in respective laterally inwardly projecting arms 6, 7. The base portion 1, the tongues 2, 3, the legs 4, 5 and the arms 6, 7 are all formed integrally with each other from a single resilient metal sheet.

The two laterally inwardly projecting arms 6, 7 are interconnected by a contact element 8 which is welded to the two arms 6, 7, interconnecting them in a stressed condition in which the arms are drawn together, causing stressing of the two legs 4, 5 and resulting in a slight dished deformation of the base portion as illustrated in FIG. 1.

The outwardly projecting tongue 2 terminates in a flat integral mounting tab 9 of greater width than the remainder of the tongue 2, the tab 9 having two holes 10 by means of which it can be anchored firmly to a fixed support, so that the entire blade projects cantilever-fashion from this support. When mounted in this way, and prestressed for snap action as described above, the switch blade is predisposed to effect snap movement of the contact element 8 relative to the fixed blade support and, therefore, relative to a fixed switch contact (not shown) when an operating force is applied to the end of the inwardly projecting tongue 3. The tongue 3 may be formed with a raised protuberance 11 near its free end, forming a well defined surface for engagement by a switch operating member (not shown) which applies an operating force indicated by the arrow P in FIGS. 1 and 4.

When an operating force P is applied to the central inwardly projecting tongue 3 of the blade this force is resisted by resilient flexing of the outwardly projecting tongue 2 which supports the blade, while at the same time the inwardly projecting tongue 3 itself bends relative to the base portion 1, until a well defined threshold value of the force P is reached, when the additional stress imparted to the blade by the force P results in instability of the blade, when the entire blade will undergo snap deformation to a condition in which the dish deformation of the base portion 1 is reversed, this deformation being accompanied by movement of the legs 4, 5, and therefore of the contact element 8, in the opposite direction to the deflection of the central tongue 3 by the force P. According to the relative positioning of a fixed contact the resulting snap movement of the contact element 8 will result in snap closure or opening of a switch.

The switch blade can be designed so as to be monostable or bistable in operation. In the monostable version of the switch blade illustrated here, the switch blade reverts to its original stressed condition when the operating force P is removed or falls below a further threshold value. In the embodiment illustrated in FIG. 1 the application of the operating force P causes snap movement of the contact element 8 into engagement with a fixed contact (not shown) of a switch, and the subsequent release of the force P results in snap opening of the switch contacts.

By appropriate proportioning of the width of the outwardly projecting tongue 2 which supports the blade cnatilever-fashion, the blade can be predisposed for bistable operation, whereby, once having undergone snap deformation from its original stressed condition (FIG. 1) it assumes a stable condition with the opposite dished deformation to that shown in FIG. 1.

The flexural elasticity of the two legs 4, 5 and the arms 6, 7 serves to enhance the snap movement of the contact element 8 carried thereby by virtue of the inertia of the relatively massive contact element 8: before the instant of contact separation the legs 4, 5 and the arms 6, 7 will bend elastically, releasing their stored energy when the contact element 8 "unsticks" to cause rapid movement of the contact element 8 relative to the fixed contact.

The fabrication of a snap action switch blade according to another embodiment of the invention will be described with reference to FIGS. 2 and 3.

Figure 2:
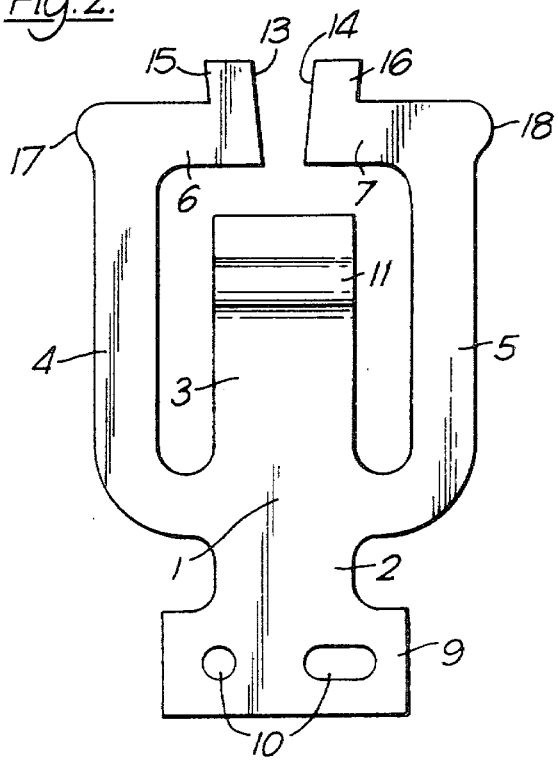
FIG. 2 is a plan view of a blank from which a switch blade according to another embodiment of the invention may be made.
Figure 3:
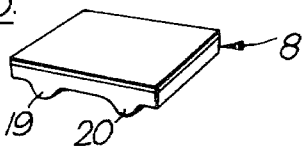
FIG. 3 is a perspective view of a contact element adapted to be welded to the blade blank shown in FIG. 2.

FIG. 2 shows a flat sheet metal blank 12 stamped in a single piece from resilient conductive material such as, for example beryllium copper sheet. In the flat blank the legs 4, 5 are parallel to each other and to the central inwardly projecting tongue 3, and the outwardly projecting tongue 2 is coplanar with the inner tongue 3. The two laterally inwardly projecting arms 6, 7 at the ends of the legs 4, 5 are also coplanar, and terminate in respective edges 13, 14 which converge towards the base portion 1 and which are separated by a suitable gap to allow the subsequent prestressing of the blade. In the illustrated embodiment the edges 13, 14 converge at an angle of approximately 6°. The two laterally inwardly projecting arms 6, 7 terminate in end portions 15, 16 of enlarged width, the two arms 6, 7 themselves in this embodiment being narrower in width than the respective legs 4, 5 which carry them.

Two shallow outwardly projecting rounded lugs 17, 18 are formed at the ends of the respective legs 4, 5 adjoining the arms 6, 7.

After stamping the blade blank 12 shown in FIG. 2 and deforming the central inwardly projecting tongue 3 to form the raised protuberance 11, the blade blank is placed in a jig with the flat tab 9 anchored in a fixed support or clamp forming part of a jig which includes pneumatically operated pistons which act upon the external lugs 17, 18 of the blank to deform the legs 4, 5 inwardly towards each other, closing or substantially closing the gap between the edges 13, 14. The pistons may be arranged to bring the edges 13, 14 into edge to edge abutment with each other, or alternatively may incorporate stops to reduce the size of the gap between the edges 13, 14 by a predetermined amount only. When the pistons have deformed the blade blank in this way the contact element 8 is placed in position on the end portions 15, 16 of the arms 6, 7 and welded in position, thereby permanently interconnecting the arms 6, 7 and maintaining the blade in a stressed condition, as illustrated in FIGS. 4 and 5.

The contact element 8 is of bimetal construction, having a base layer of suitable material capable of being welded to the blade blank 12. The contact element is formed with two raised parallel ridges 19, 20 (FIG. 3). The ridges 19, 20 are pressed into contact with the respective end portions 15, 16 of the blade blank upon assembly of the blade, and after inward deformation of the arms 6 and 7 towards each other the contact element 8 is welded to the end portions along the ridges 19, 20 by the passage of a suitable welding current between the contact element 8 and the blade itself, thereby securing the contact element 8 to the arms 6 and 7 and interconnecting the latter in a stressed condition of the blade. Superimposed upon the base layer of the contact element 8 is a contact layer of silver cadmium oxide, or some other suitable conductive material.

The contact element 8 may conveniently be cut from a continuous strip of the aforesaid bimetal, extruded with the raised ridges 19, 20 extending longitudinally, the strip being cut transversely of the ridges to form the contact element 8, without any subsequent finishing operation being necessary.

Figure 4:
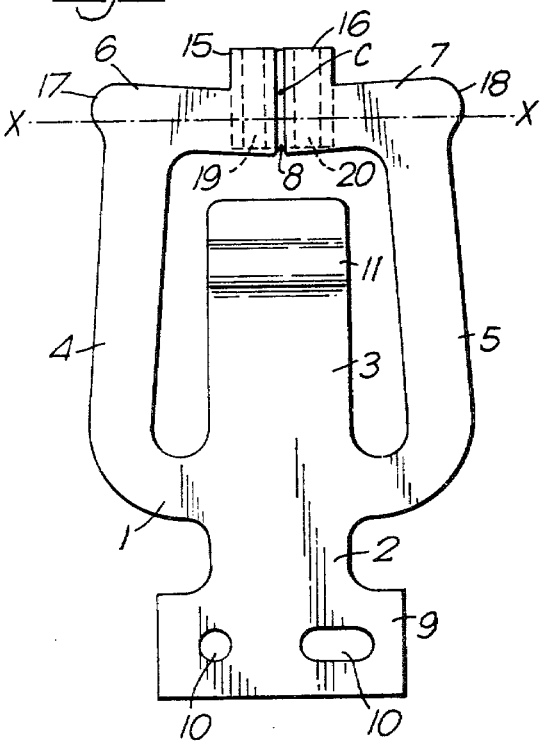
FIG. 4 is a plan view of a switch blade according to the invention made from the blank shown in FIG. 2, and the contact element shown in FIG. 3.
Figure 5:
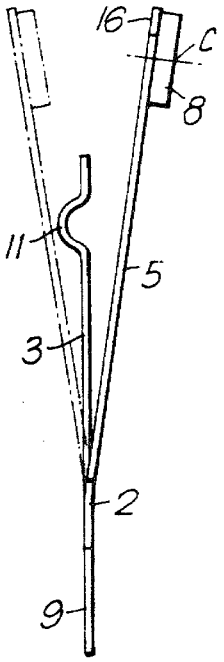
FIG. 5 is a side elevation of the blade shown in FIG. 3.

It will be seen that in the finished switch blade the centre of the contact element 8, indicated C in FIG. 4, at which contact pressure is applied when the contact element 8 engages a fixed contact, is spaced from the centreline axis X-X of the aligned laterally inwardly projecting arms 6, 7 of the blade. This results in the generation of a moment about the axis X-X when the centre C of the contact element 8 is engaged by a fixed contact, leading to an elastic torsional deformation of the two arms 6, 7 about the axis X-X due to the contact pressure exerted on the contact element, upon its closure against a fixed contact. Such torsional deformation serves to absorb the kinetic energy of the contact element 8 upon closure of the switch contacts, acting in a shock-absorbing capacity and minimizing the tendency for contact bounce to occur. The torsional deformation and therefore the shock absorbing effect will be proportional to the kinetic energy to be absorbed.

The torsional deformation of the arms 6, 7 also has the effect of imparting a slight twisting action to the contact element 8 about a transverse axis parallel to the axis X-X of the arms 6, 7, resulting in a rocking or wiping movement of the contact element 8 upon the fixed contact prior to separation of the contacts and serving to break any welds between the contacts.

The contact element 8 in the switch blade of FIGS. 4 and 5 is on the opposite face of the blade from the contact element 8 in the embodiment of FIG. 1: either position may be adopted for the contact element according to the switching requirement.

We claim:

1. A snap action switch blade of resilient sheet metal comprising a base portion, an inwardly projecting tongue, an outwardly projecting tongue, two resilient legs projecting from opposite sides of the base portion, said legs terminating beyond the inwardly projecting tongue and merging in respective resiliently deflectable arms which project laterally inwardly towards each other, and a contact element affixed to and interconnecting laterally inwardly projecting end portions of the arms, said contact element drawing said arms toward each other to produce a dish deformation of said base portion predisposing the blade for snap movement of the contact when an operating force is applied to one of the tongues while the end of the other tongue is anchored.

2. A switch blade as claimed in claim 1, wherein the outwardly projecting tongue is substantially aligned with said inwardly projecting tongue and terminates in a flat portion adapted to be anchored to a fixed support, the flat portion having a greater width than the remainder of the outwardly projecting tongue.

3. A switch blade as claimed in claim 1, wherein the two laterally inwardly projecting arms have a common longitudinal centerline and said portions are of enlarged width relative to the width of said arms, said contact element having a central contact area which is spaced from said longitudinal centerline of the two arms, whereby contact pressure exerted on said contact area causes torsional stress in the two arms.

4. A switch blade as claimed in claim 3, wherein the two laterally inwardly projecting arms are narrower in width than the two legs of the switch blade which carry the said arms.

5. A switch blade as claimed in claim 1, wherein the contact element has a base which is affixed to the two laterally inwardly projecting arms and an electrically conductive contact layer which is deposited on or bonded to the base.

6. A switch blade as claimed in claim 1 or claim 3 wherein said end portions extend from said arms in a direction away from said inwardly projecting tongue.

* * * * *